United States Patent [19]

King et al.

[11] 4,105,355

[45] Aug. 8, 1978

[54] DEVICE FOR TAMPING AND LEVELING CONCRETE AND THE LIKE

[76] Inventors: Junior Keith King, R.R. 1, Box 106A; Lowell W. Warden, 304 3rd St., both of Russiaville, Ind. 46979

[21] Appl. No.: 734,303

[22] Filed: Oct. 20, 1976

[51] Int. Cl.[2] ..... E01C 19/38

[52] U.S. Cl. ..... 404/114; 404/118

[58] Field of Search ..... 404/114, 113, 119, 118

[56] References Cited

U.S. PATENT DOCUMENTS

| | | | |
|---|---|---|---|
| 1,943,076 | 1/1934 | Jackson | 404/114 X |
| 2,094,910 | 10/1937 | Baily | 404/114 X |
| 2,141,301 | 12/1938 | Jackson | 404/114 |
| 2,255,343 | 9/1941 | Baily | 404/114 |
| 2,261,766 | 11/1941 | Jackson | 404/114 |
| 2,306,124 | 12/1942 | Jackson | 404/114 |
| 2,314,985 | 3/1943 | Jackson | 404/114 |
| 2,322,362 | 6/1943 | Jackson | 404/114 |
| 2,651,980 | 9/1953 | Wells | 404/113 |
| 2,952,193 | 9/1960 | Converse | 404/113 |

FOREIGN PATENT DOCUMENTS

| | | | |
|---|---|---|---|
| 467,089 | 8/1950 | Canada | 404/114 |
| 610,568 | 10/1948 | United Kingdom | 404/114 |

*Primary Examiner*—Nile C. Byers

*Attorney, Agent, or Firm*—Woodard, Weikart, Emhardt & Naughton

[57] ABSTRACT

A device is disclosed herein for simultaneously tamping and leveling concrete and similar materials. The device includes an elongated, rectangular enclosure having a substantially flat bottom for acting upon the concrete or other material. A shaft extends within and is rotatably mounted to the enclosure, and is connected at one end to a motor which is operable to drive the shaft in rotation. Several weights are eccentrically mounted upon the shaft at evenly spaced locations. Preferably several bearing houses are mounted within the enclosure and the shaft is rotatably received therein, each of the several weights being positioned adjacent one of the bearing houses. A handle extends outwardly from one end of the enclosure and the motor which drives the shaft is preferably mounted upon the handle at a location spaced outwardly of the enclosure. The other end of the enclosure may include a handle or may rest upon a stake received within a downwardly open aperture in the enclosure.

5 Claims, 4 Drawing Figures

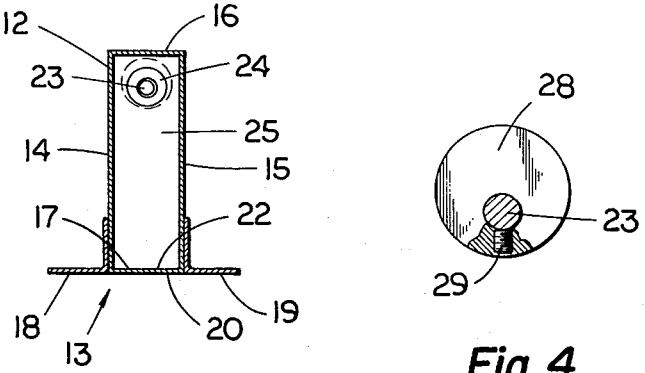
Fig. 4
Fig. 3
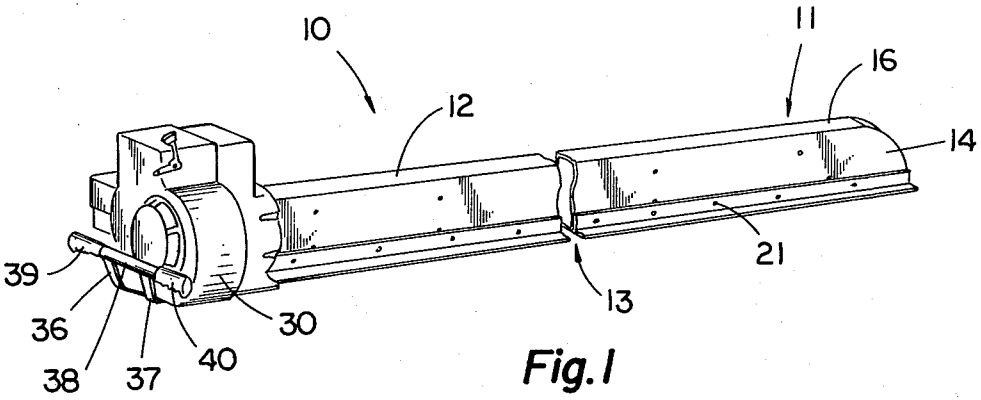
Fig. 1
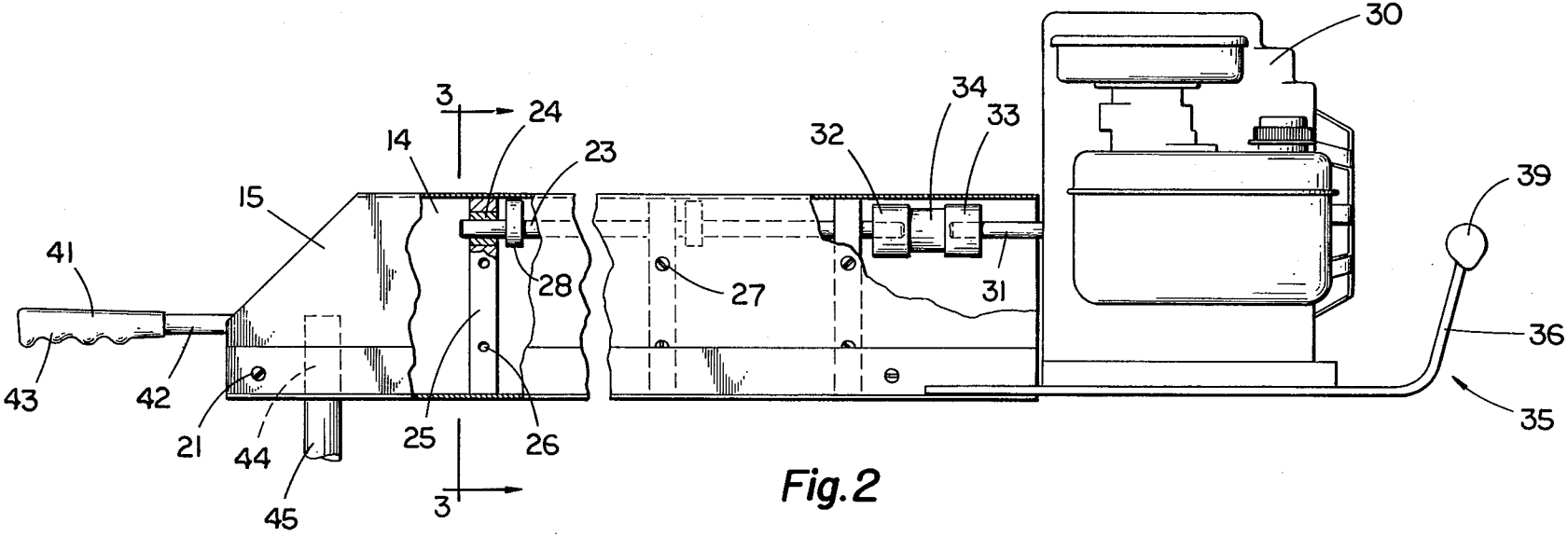
Fig. 2

DEVICE FOR TAMPING AND LEVELING CONCRETE AND THE LIKE

BACKGROUND OF THE INVENTION

1. Field of the Invention

The present invention relates to a device for simultaneously tamping and leveling concrete and similar materials, and more particularly relates to a device of the described type which includes a work-engaging surface of substantial length to facilitate use of the device upon a segment of material having a relatively large surface area.

2. Description of the Prior Art

It is generally recognized and appreciated that the strength and appearance of materials such as concrete may be enhanced by compacting the plastic mass by tamping and vibrating the material. A variety of mechanical devices have been designed for performing these operations and for reducing the amount of manual labor required. It is of course desirable that these devices perform properly and efficiently, while being inexpensive and easy to operate. In addition to working the concrete or similar material to increase the density and appearance, it is also desirable that these devices assist in the leveling and planing of the material. A typical device of this type customarily innclude a member having a work-engaging surface, a motor superposed upon the member for rotating or vibrating the same, and a handle to facilitate control over the device. The devices of the prior art, however, have generally been poorly suited to certain applications, such as leveling and tamping concrete and the like which has a substantial surface area.

The concept of applying a vibratory motion to the work-engaging surface is known in the art. In U.S. Pat. No. 1,657,727, issued to Stubbs on Jan. 31, 1928, there is disclosed a device for compacting concrete which includes a generally rectangular bottom surface and means for vibrating the surface. The surface is vibrated by a series of reciprocating plungers which are mounted directly above the surface member. Although the Stubbs' device is suitable for its intended purposes, the design of the device is not practically adaptable to use with a work-engaging surface member of substantial length. If the work-engaging member were expanded in dimensions over that indicated in the patent, the number of reciprocating plungers would be sufficiently great that the device would be unmanageably heavy and bulky and would also be expensive. Similar comments are appropriate with respect to the devices disclosed in U.S. Pat. Nos. 3,386,353, issued to Wells on June 4, 1968, and 2,209,656, issued to Mall on July 30, 1940. The devices disclosed in each of these patents includes a relatively small work-engaging surface member with a relatively large motor mounted thereupon. The mere expanding of the size of the work-engaging member would result in a device which would be considerably bulky and difficult to manipulate.

The difficulties which arise with respect to the working of a large area of concrete or similar material are suggested in U.S. Pat. No. 2,048,071, issued to Jacobson on July 21, 1936. The patent discloses a device which has a substantial length dimension, and which may be vibrated to tamp and level the material upon which it is acting. The Jacobson device is particularly intended for finishing concrete pavements and the like and includes a roller of considerable length for engaging the concrete.

The Jacobson device, however, employs a complicated mechanism for suspending and vibrating the roller, and as a result entails considerable expense and bulk. It would certainly be preferable to provide a tamping and leveling device which could operate over a large surface area but which would not entail such complexities of design and function.

SUMMARY OF THE INVENTION

A device is disclosed herein for tamping and leveling concrete and the like which comprises an elongated member having a substantially flat bottom surface, a housing mounted to the member above the member, a shaft extending parallel to the bottom surface of the member, the shaft being rotatably mounted within the housing, several weights eccentrically mounted upon the shaft at spaced apart locations within the housing, drive means for rotating the shaft and the weights mounted thereupon, and handle means for permitting control of the movement of the member along a surface.

It is an object of the present invention to provide a device which is useful for tamping and leveling a variety of plastic materials such as concrete, and more particularly to provide a device which is useful for acting upon a plastic mass of substantial area.

Another object of the present invention is to provide a tamping and leveling device which is simple in construction and operation and which is inexpensive.

A further object of the present invention is to provide a tamping and leveling device which includes a work-engaging surface having substantial length, and which is nevertheless light weight and easy to manipulate.

It is another object of the present invention to provide a tamping and leveling device which operates easily and efficiently, and which may be handled by either one or two persons.

A further object of the present invention is to provide a tamping and leveling device of the described type which does not expose the moving parts thereof to the plastic mass being worked upon, and particularly which locates the drive motor to one side away from the plastic mass.

Further objects and advantages of the present invention will become apparent from the description which follows, and particularly in connection with the figures referred to therein.

BRIEF DESCRIPTION OF THE DRAWINGS

FIG. 1 is a perspective view of the tamping and leveling device of the present invention.

FIG. 2 is a side, elevational view of the device of FIG. 1, a portion of the enclosure being shown broken away to reveal the interior structure.

FIG. 3 is an end, cross-sectional view of the tamping and leveling device, taken along the line 3—3 in FIG. 2 in the direction of the arrows.

FIG. 4 is an end view showing the mounting of an eccentric weight upon the shaft.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The device of the present invention provides a simple, inexpensive and efficient apparatus for leveling and tamping concrete and similar materials. In particular, the construction of the tamping and leveling device results in an apparatus which is useful for acting upon a mass which has a substantial area. The device of the present invention may, for example, be easily manipulated by either one or two persons to level and tamp a concrete slab floor or road section.

Referring now to the figures, there is shown a tamping and leveling device 10 in accordance with the present invention. Device 10 includes an enclosure 11 within which a rotatable shaft 23 (FIG. 2) is received. Enclosure 11 comprises an elongated bottom 13 and a housing 12 mounted thereupon. Housing 12 is preferably rectangular and includes vertical, spaced apart sides 14 and 15 and top 16, which extends between and perpendicular to the sides. Housing 12 further includes a bottom member 17 which in the preferred embodiment of the device 10 forms a portion of elongated bottom 13. L-shaped members 18 and 19 are secured to sides 14 and 15, respectively, by screws or rivets 21. Bottom member 17 and members 18 and 19 combine to form a generally rectangular work-engaging bottom surface 20 which is substantially flat.

Rotatably mounted within housing 12 of enclosure 11 is a shaft 23. Shaft 23 is preferably positioned parallel to bottom surface 20, and also preferably is located within the plane which extends perpendicular to the bottom surface 20 and through the longitudinal axis 22 of member 17. More generally, shaft 23 preferably is positioned above the longitudinal center line of bottom 13.

Shaft 23 is rotatably mounted within several shaft bearings 24 which are supported within bearing houses 25. Houses 25 are suitably secured to housing 12 such as by screws 27 which are received within holes 26 in the bearing houses. Several weights 28 are mounted upon shaft 23. Weights 28 are suitably secured to shaft 23, as for example by frictional engagement of shaft 23 by set screws 29, which are threadedly received within apertures defined by the weights 28. The weights 28 are preferably secured to shaft 23 at equally spaced locations, and more preferably each weight 28 is positioned adjacent one of the bearing houses 25. The eccentric weights 28 impart a vibrational motion to bottom 13 upon rotation of shaft 23. The location of weights 28 proximate to the bearing houses 25 prevent excessive vibration of the unit from occurring.

A motor 30 is mounted to enclosure 11 at a position spaced outwardly from one end of enclosure 11. Motor 30 includes a drive shaft 31 which is preferably aligned coaxial with shaft 23 and connected thereto. The connection of drive shaft 31 and shaft 23 is preferably accomplished so as to minimize the transmittal of vibrations from shaft 23 to motor 30. A preferred structure for accomplishing this connection is a jolly coupler which includes resilient and shock absorbing members 32 and 33 secured to shaft 23 and drive shaft 31, respectively. A rigid connector 34 is secured to each of the bodies 32 and 33. In operation, the vibrations which result from the rotation of shaft 23 will be substantially prevented from being transmitted directly to drive shaft 31 due to the absorption and dissipation of the vibrations by bodies 32 and 33.

Mounted upon enclosure 11 and extending outwardly from one end thereof is a handle 35. Handle 35 comprises outwardly-extending arms 36 and 37 connected at their ends by bar 38. Grips 39 and 40 are positioned upon bar 38 to provide a convenient and comfortable hand hold for the user of device 10. Preferably the motor 30 is mounted upon arms 36 and 37 to further reduce the transmittal of vibrations to motor 30. Further, the weight of motor 30 upon handle 35 will reduce the transmittal of vibrations to the bar 38, and therefore to the user of the device. The positioning of motor 30 is additionally advantageous for the reason that the user may most conveniently support and control the weight of motor 30 as device 10 is moved over the surface of the concrete or other material.

Means are provided at the opposite end of device 10 for controlling the movement thereof. A handle 41 is mounted to enclosure 11 and extends generally outwardly therefrom. Handle 41 comprises a bar 42 and a grip 43. When device 10 is utilized by two persons such as in leveling a road section or other large rectangular area of concrete or the like, the handle 41 is used by the person at that end to guide device 10 across the surface of the material. The higher and wider handle 35 enables the user at that end to control the weight of the motor and also to guide that end of the device 10. In combination, the two persons may easily guide the device across the surface of the material and may apply downward pressure as required to assist the device in leveling the material.

The device 10 may also be utilized by a single person grasping handle 35. The location of motor 30 and the size and positioning of handle 35 makes it possible for a single person to control the entire device 10 from the one position. Alternatively, a stake 45 may be inserted within downwardly-open aperture 44 in enclosure 11. The stake is then secured to or within the ground adjacent the material which is desired to be tamped and leveled. The user holding the device at handle 35 may then move device 10 to pivot about the stake 45 to tamp and level an arcuate portion of material. This use of device 10 is particularly adapted to the tamping and leveling of circular or pie-shaped sections of concrete or similar material. A particular application in this regard is the formation of concrete slab floors for cylindrical structures such as farm storage bins or related structures. It may in this use of device 10 be necessary to position the stake within the material being leveled, in which case the stake is subsequently removed and the hole formed by the stake may be easily hand troweled as required.

Although the present invention is not to be limited thereby, a preferred physical embodiment of the present invention having particular sizes and dimensions has been constructed in accordance with the present invention. In this preferred construction, the enclosure has a length of 19 feet and handle 35 extends an additional foot from the end of the enclosure. As indicated above, the sizes and dimensions recited herein are considered to be exemplary of an advantageous construction of the present invention, it being understood that the sizes and dimensions may be altered as desired or as necessary for a particular application. For example, the length of enclosure 11 is stated to have a preferred measurement of nineteen feet, but it is clear that the present invention would contemplate an enclosure of a different length. In a preferred embodiment, however, enclosure 11 is at least eight feet in length, since the particular advantages of the present invention are most readily apparent in the construction of a device which can operate on a mass of substantial area. In particular, the present invention provides an apparatus which may tamp and level a concrete or similar mass which has a substantial area without it being necessary to move the device in any but a single direction across the material.

In further respect to the particular physical embodiment of the present invention, the housing 12 has a rectangular cross-section of two inches by six inches, and L-shaped members 18 and 19 comprise one and one-half inch by one and one-half inch angle irons welded or otherwise secured to sides 14 and 15. The eccentric weights would then preferably comprise cylindrical bodies having a width of about one half inch and a diameter of approximately one and three quarters inches, and the weight would be offset so as to clear the interior of housing 12 by about one eighth inch. Each weight is preferably mounted approximately one quarter inch away from the respective bearing house 25. A three horsepower motor marketed by Briggs & Stratton has been utilized to operate a tamping and leveling device of the described construction, although a motor of more or less horsepower would also be suitable. The described embodiment as a unit weighs between 110 and 120 pounds, and is therefore seen to be of sufficient light weight as to be operable by one or two persons, and at the same time can act upon a relatively large mass of concrete or similar material to provide the required tamping and leveling effect. To insure the light weight of the device, it is preferable that the device be formed from as much light weight material, such as aluminum, as is mechanically feasible. The device has been found to be of sufficient light weight to be manageable, and yet has a sufficient weight to act suitably upon concrete and similar materials.

The device of the present invention is simple in construction and operation, and yet is efficient and easily managed. The device both tamps and levels materials such as concrete, and results in the escape of air from the material to further enhance the strength and appearance of the material. The positioning of the motor and the inclusion of enclosure 11 provides a sufficient shield from the splattering of the material upon which the device is acting. The portions of the device which are exposed to such splattering are shaped so as to be easily cleaned after use of the device.

While there have been described above the principles of this invention in connection with specific apparatus, it is to be clearly understood that this description is made only by way of example and not as a limitation in the scope of the invention.

What is claimed is:

1. A device for tamping and leveling concrete and the like which comprises:

an elongated member having a substantially flat bottom surface, said member defining a downwardly-open aperture adjacent an end of said member;

a housing mounted to said member above said member;

a shaft extending parallel to the bottom surface of said member, said shaft being rotatably mounted within said housing;

several weights eccentrically mounted upon said shaft at spaced apart locations within said housing;

drive means for rotating said shaft and said weights mounted thereupon, said drive means including a motor connected to and operable to rotate said shaft, the motor being mounted to and supported by said member and positioned adjacent an end of said member; and handle means for permitting control of the movement of said member along a surface, said handle means including a stake received within and extending downwardly through the aperture defined by said member.

2. The device of claim 1 in which said enclosure is rectangular and includes parallel, spaced apart vertical sides extending upwardly from the bottom surface and further includes a top extending between and perpendicular to the sides.

3. The device of claim 1 in which the bottom surface of said enclosure is rectangular and has a longitudinal axis, said shaft extending in a plane which is perpendicular to and extends through the longitudinal axis of the bottom surface of said enclosure.

4. The device of claim 1 in which said handle means includes a handle connected to and extending outwardly from a first end of said enclosure, the motor of said drive means being mounted upon the handle of said handle means at a location spaced outwardly from said first end, the aperture of said member being located adjacent the second end of said member.

5. The device of claim 1 in which the motor of said drive means includes a drive shaft operable to be rotated by the motor, the drive shaft being coaxial with and connected to said shaft.

* * * * *